US006186380B1

(12) United States Patent
Grounds

(10) Patent No.: US 6,186,380 B1
(45) Date of Patent: Feb. 13, 2001

(54) COMBINATION SLEEPING PAD AND BACKPACK

(76) Inventor: Phillip S. Grounds, 685 Josephine Ave., Columbus, OH (US) 43204

( * ) Notice: Under 35 U.S.C. 154(b), the term of this patent shall be extended for 0 days.

(21) Appl. No.: 09/421,638

(22) Filed: Oct. 20, 1999

(51) Int. Cl.[7] ..... A45F 4/06

(52) U.S. Cl. ..... 224/156; 5/419; 5/420; 190/2; 383/4

(58) Field of Search ..... 383/4, 907; 5/417, 5/419, 420; 224/156; 190/2

(56) References Cited

U.S. PATENT DOCUMENTS

| | | | | |
|---|---|---|---|---|
| 2,133,717 | | 10/1938 | Robes, Jr. | 5/343 |
| 3,173,465 | * | 3/1965 | Pastini | 383/4 |
| 3,730,407 | | 5/1973 | Russell | 224/9 |
| 3,818,962 | * | 6/1974 | Muller-Scherak | 383/4 |
| 4,375,111 | | 3/1983 | Hall | 5/419 |
| 4,516,668 | | 5/1985 | Grayek | 190/2 |
| 4,518,198 | * | 5/1985 | Daniels | 297/118 |
| 4,604,765 | * | 8/1986 | Schultz | 5/413 |
| 4,723,300 | * | 2/1988 | Rosalind | 383/4 |
| 4,942,948 | * | 7/1990 | Vickers | 190/1 |
| 4,984,906 | * | 1/1991 | Little | 383/4 |
| 5,048,975 | * | 9/1991 | Holbrook | 383/4 |
| 5,110,219 | * | 5/1992 | Lopes | 383/4 |
| 5,533,653 | | 7/1996 | Kaufman | 224/577 |
| 5,641,199 | * | 6/1997 | Bond-Madsen | 224/153 |

FOREIGN PATENT DOCUMENTS

| | | | | |
|---|---|---|---|---|
| 1264919 | * | 2/1972 | (GB) | 383/4 |
| 5130910 | * | 5/1993 | (JP) | 383/4 |

* cited by examiner

*Primary Examiner*—Stephen P. Garbe
(74) *Attorney, Agent, or Firm*—John L. Gray, Esq.; Kegler, Brown, Hill & Ritter

(57) ABSTRACT

A combination sleeping pad and backpack which may be used as a sleeping pad that when assembled and fastened together, portions of the pad function as a backpack.

4 Claims, 5 Drawing Sheets

COMBINATION SLEEPING PAD AND BACKPACK

BACKGROUND OF THE INVENTION

Sleeping pads and backpacks are routinely carried by campers. However, they are usually separate items. U.S. Pat. No. 2,133,717 is a sleeping bag which can be folded up so that it can be carried on a person's back. The unit when folded affords a plurality of storage pockets for blankets and other necessities. U.S. Pat. No. 3,730,407 is a combination backpack and cot. There are also many sleeping pads or mats which can be folded up and carried in a bag of some type.

BRIEF SUMMARY OF THE INVENTION

The invention involves a padded sleeping pad which when folded and held together by zippers that are provided creates a backpack which can contain a large number of items which the average camper would need for his camping trip. When the contents from the backpack are removed and the zippers are unzipped and the backpack is laid out, it becomes a padded sleeping pad.

It is therefore an object of this invention to provide a combination sleeping pad and backpack which is comfortable to use.

It is another object of this invention to create a combination sleeping pad and backpack which may be readily converted from one form to another.

This, together with other objects of the invention, will become apparent from the following detailed description of the invention and the accompanying drawings.

DETAILED DESCRIPTION OF THE INVENTION

Figure 1:
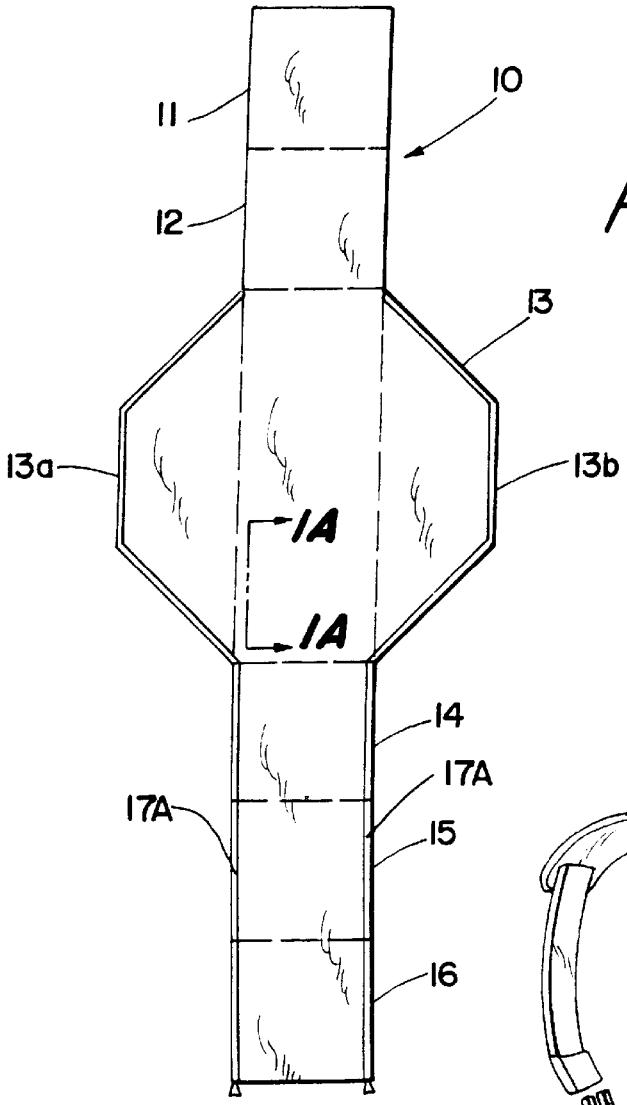
FIG. 1. A plan view of applicant's invention in the form of a sleeping pad.
Figure 1A:
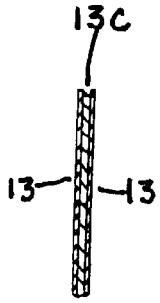
FIG. 1A. A section of applicant's invention shown in FIG. 1 on the section line 1A—1A.
Figure 2:
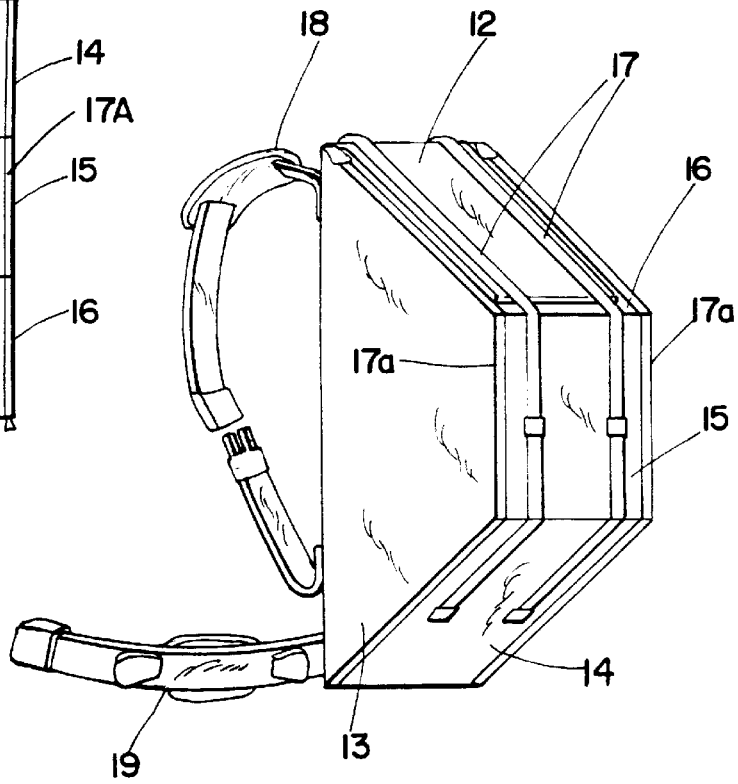
FIG. 2. A perspective view of applicant's invention when it has been reassembled as a backpack.

FIG. 1 shows the sleeping pad in open position. It comprises six segments of a double layer of material. Segment 11 is a pocket which can be filled with the user's needs and can also be used as a pillow when the invention is being used as a sleeping pad. Segments 12, 13, 14, 15, and 16 have padding between layers. As shown in FIG. 1A, the padding 13*c* lies between the two layers of material 13—13. Segments 14, 15, and 16 are provided with a zipper portion on either long edge thereof and there is a complimentary zipper portion on the outer edges of portions 13*a* and 13*b* of segment 13. Thus, when the outer portions of 13*a* and 13*b* are folded up at a 90° angle on the dotted line, and the segments 14, 15, and 16 are folded over them and when the zippers are connected, the backpack will assume the shape as shown in FIG. 2.

Figure 3:
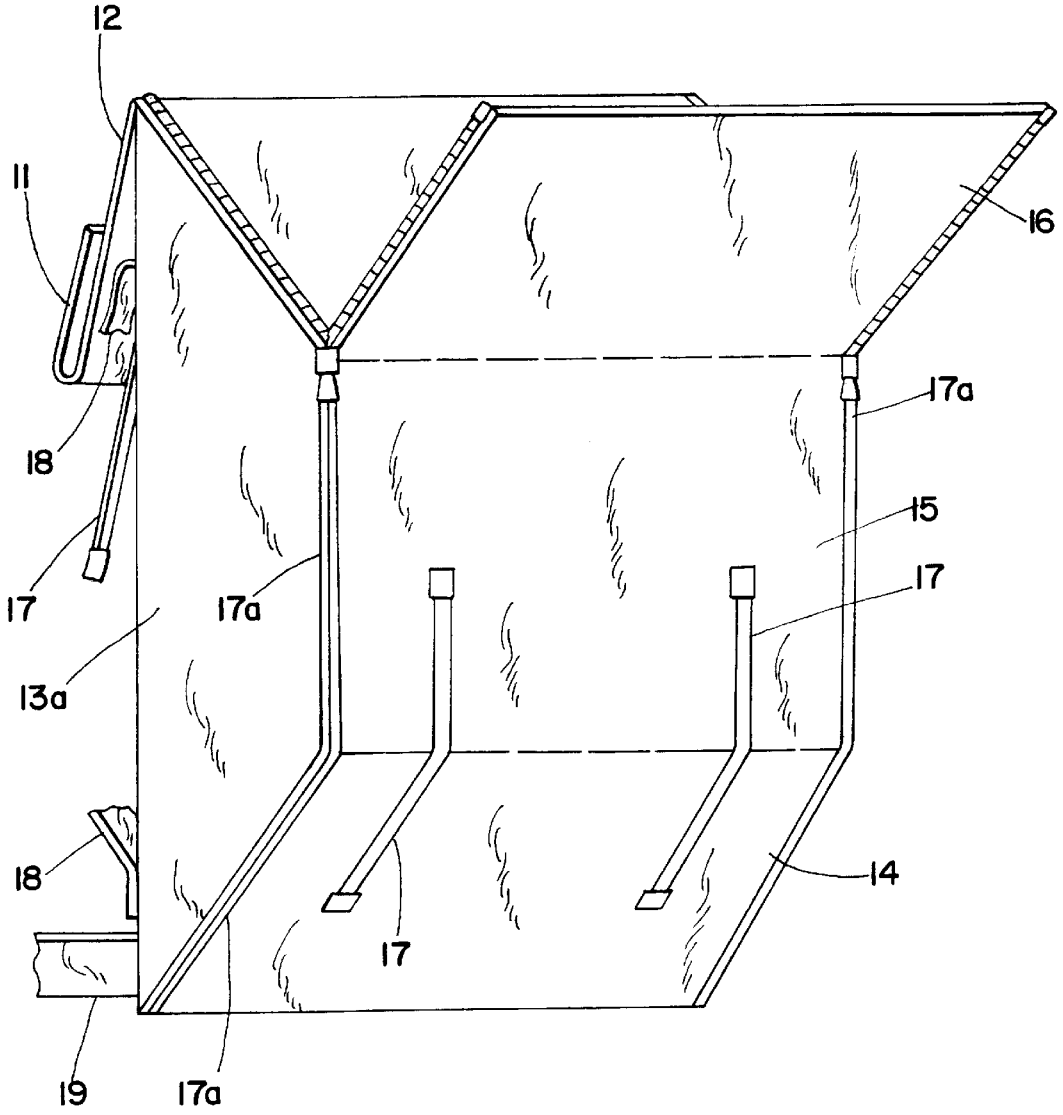
FIG. 3. A perspective view showing details of the backpack.

Straps 17—17 are provided to hold the segment 12 in place with the segment 11 folded up underneath it which is better shown in FIG. 3. FIG. 2 also shows one of the two shoulder straps 18 and the waist strap 19 to be used by the wearer when the article is being used as a backpack.

FIG. 3 is a detail of the backpack showing the various segments 14, 15, and 16 with the zipper not connected between segment 16 and the corresponding portions 13*a* and 13*b* of segment 13. When the segment 16 is folded over and the zipper is connected then the segment 11 which can be folded onto segment 12 is folded over segment 16 and the straps 17—17 are connected together to create the shape as shown in FIG. 2. Zippers 17*a*—17*a* are shown engaged.

Figure 4:
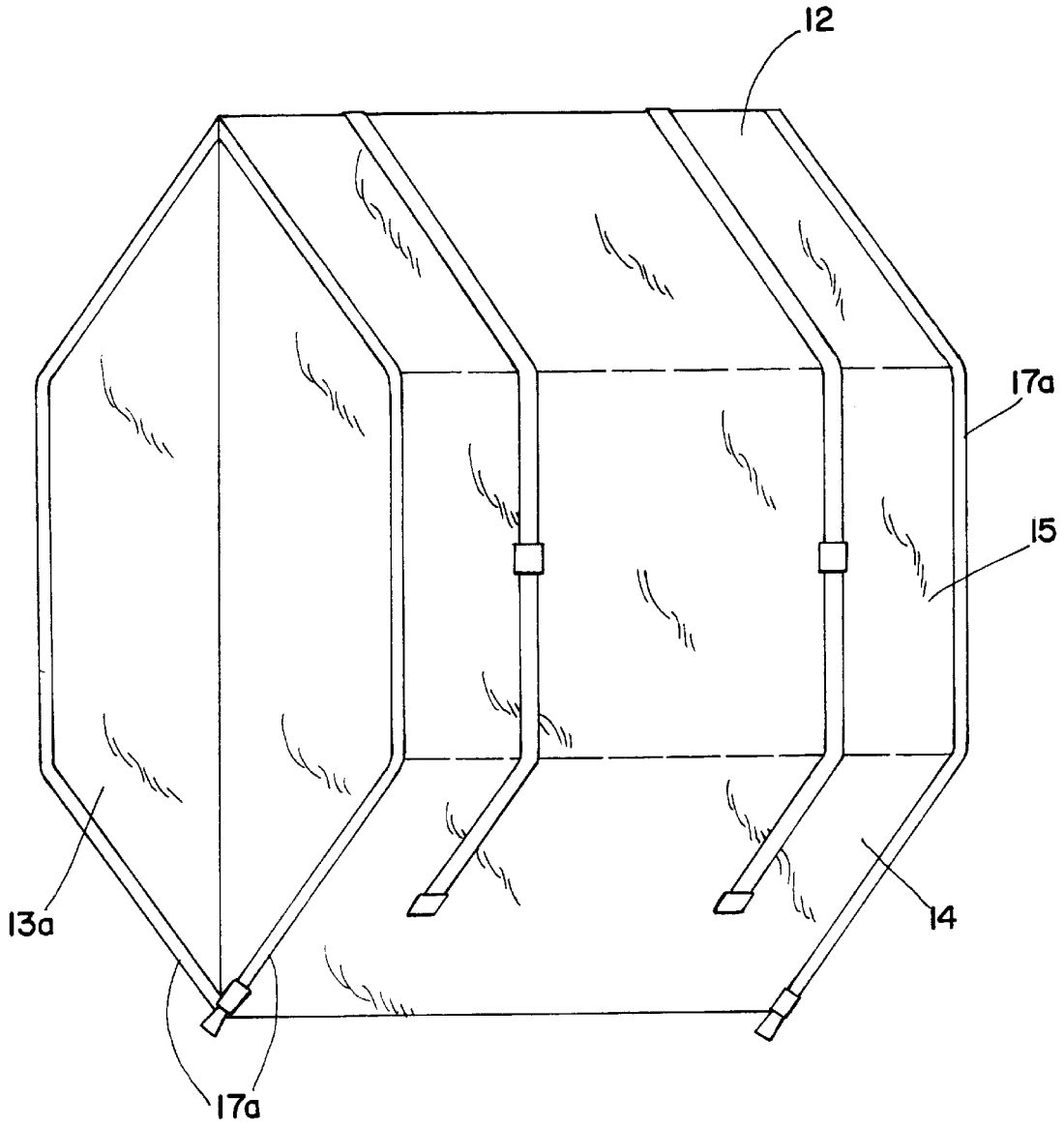
FIG. 4. A perspective view of the backpack with one side open.

FIG. 4 shows the backpack portion with one side portion 13*a* unzipped to show the ready access to the materials being carried in the backpack. Obviously the backpack may also be accessed as shown in FIG. 3.

Figure 5:
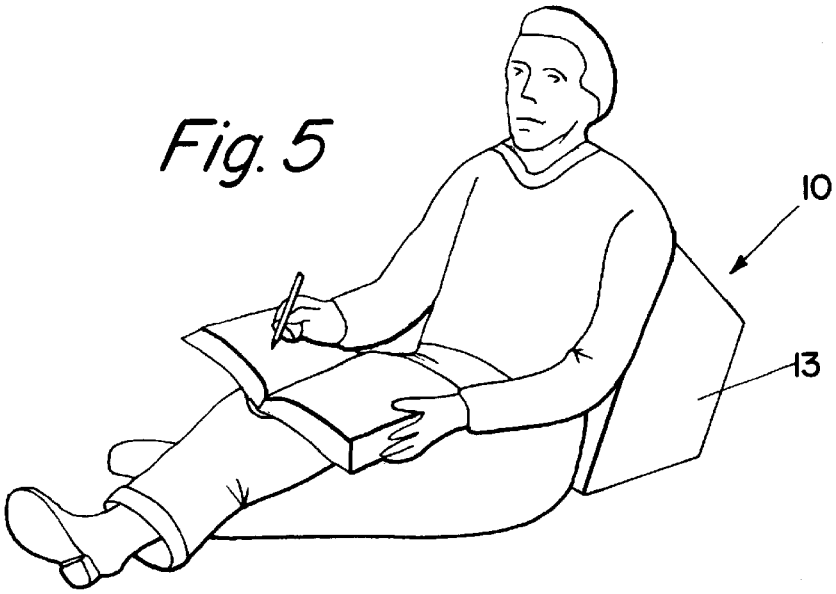
FIG. 5. The use of the backpack as backrest.
Figure 6:
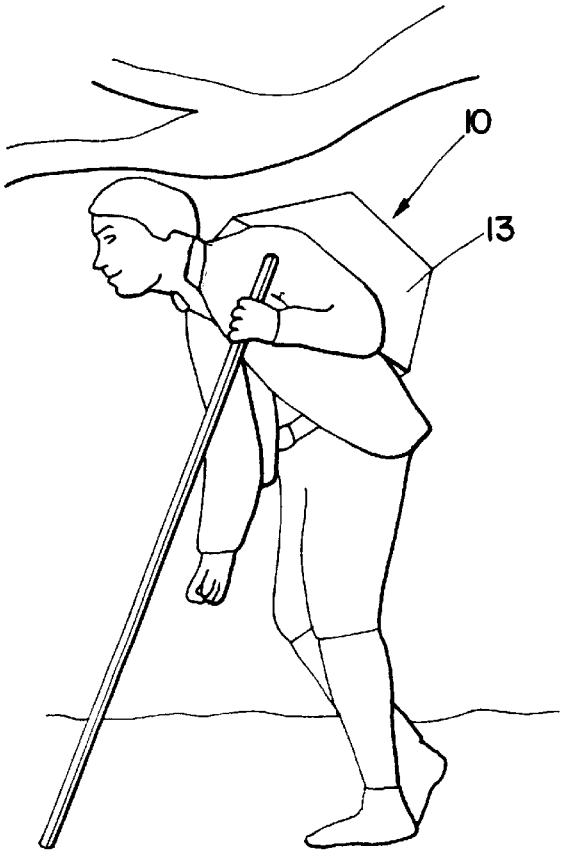
FIG. 6. The advantages of the backpack when going through overhanging tree branches and other impediments encountered in camping.
Figure 7:
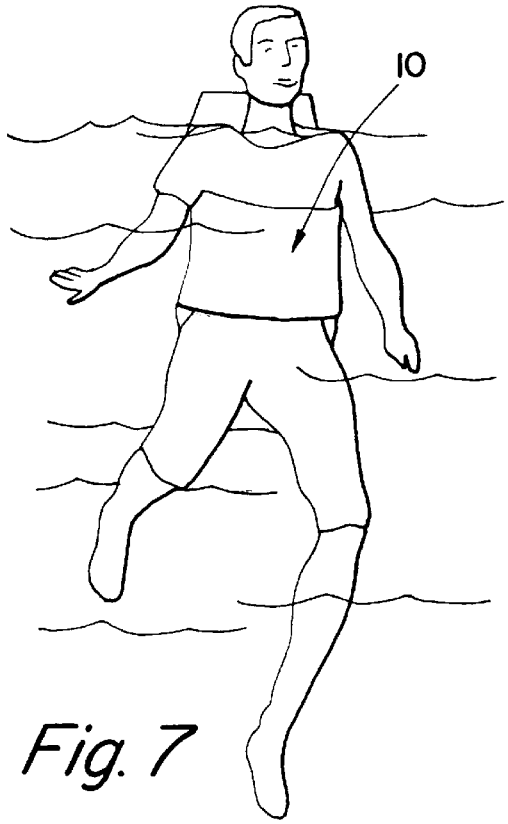
FIG. 7. The utilization of the backpack as a float device.
Figure 8:
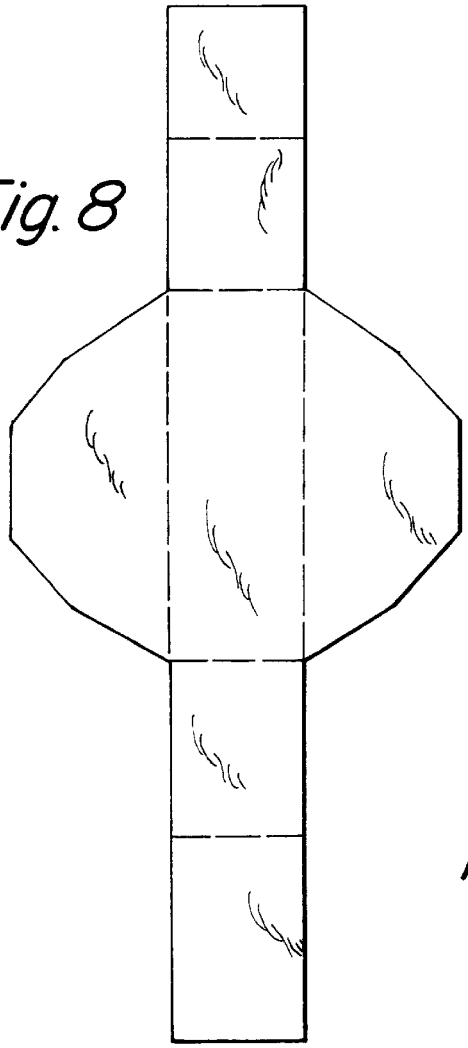
FIG. 8. A plan view of a variation in the shape of a sleeping pad.
Figure 10:
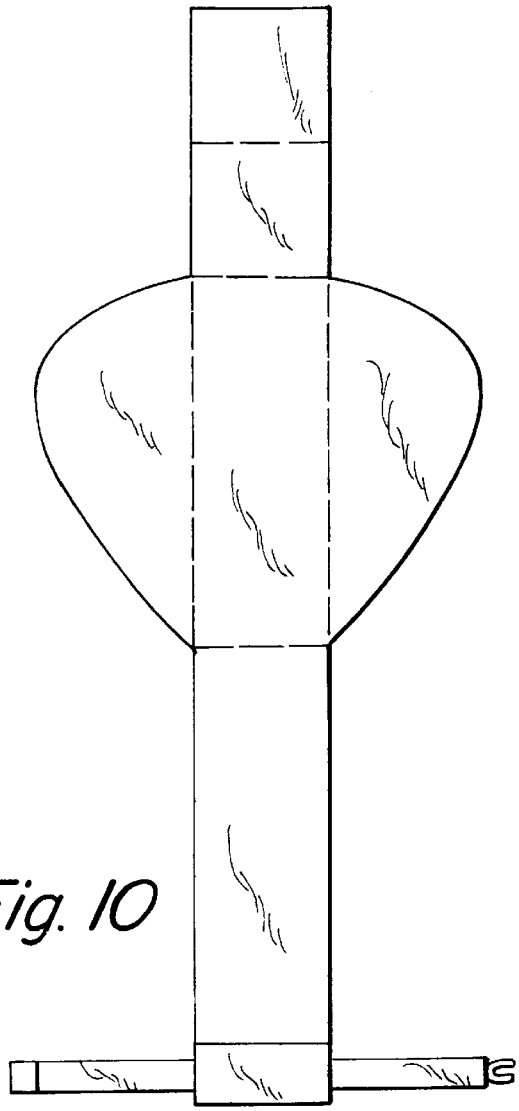
FIG. 10. A plan view of another variation in the shape of a sleeping pad; and, FIG. 11. A perspective view of the sleeping pad of FIG. 10 assembled as a backpack.
Figure 9:
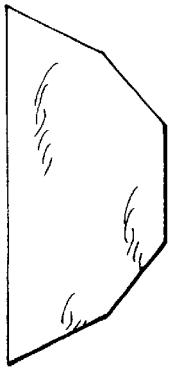
FIG. 9. A side elevation view of the same unit shown in FIG. 8 assembled in the form of a backpack.
Figure 11:
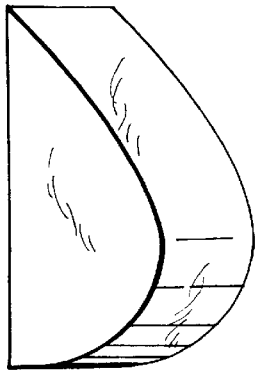

Because of the angular shape of the backpack as shown FIG. 5, it is a convenient support when the wearer is seated. Also, as shown in FIG. 6, the backpack does not extend above the shoulders of the user and slopes gradually back from the neck area of the shoulders so that when being worn, the backpack does not interfere with low lying branches or other impediments during camping expeditions. FIG. 7 shows the backpack being used as a temporary floatation device with the backpack side portions 13*a* and 13*b* unzipped. The backpack can be slipped over the head or shoulders and the buoyancy of the padding will help to support the individual. FIG. 8 shows a variation in the shape of segment 13 and FIG. 9 shows the backpack assembled from the sleeping pad shown in FIG. 8. FIG. 10 is a further variation shown as a sleeping pad and FIG. 11 shows it as a backpack.

While this invention has been shown and described with respect to a detailed embodiment thereof, it will be understood by those skilled in the art that various changes in form and detail thereof may be made without departing from the scope of the claims of the invention.

What is claimed is:

1. A combination sleeping pad and backpack comprising a double layer of material being essentially in the form of a long rectangle when placed in a horizontal position and provided with extensions on each side approximately midway of the length of said rectangle, each of said extensions terminating in outermost edges, said double layer of material being provided with padding between said layers, except for one end of said long rectangle, each of said extensions being provided on each of their outermost edges with a portion of a zipper, the portion of said long rectangle at the other end of said long rectangle and immediately adjacent said extensions being provided on each edge of each side thereof with a portion of a zipper complementary to said portions of said zippers on said extensions and adapted to engage the complimentary portions of the portions of said zippers on the outermost edges of said extensions when said portion of said long rectangle immediately adjacent said extensions is folded back so as to permit said zippers to become engaged.

2. The combination sleeping pad and backpack of claim 1 provided with straps thereon wherein said one end of said long rectangle is held in place by straps after the backpack has been assembled by means of zippers.

3. The combination sleeping pad and backpack of claim 1 which is provided with shoulder straps to fit over the user.

4. The combination sleeping pad and backpack of claim 1 which is provided with a waist strap to fit around the waist of the user.

* * * * *